US006165569A

United States Patent [19]

Cohen

[11] Patent Number: 6,165,569

[45] Date of Patent: Dec. 26, 2000

[54] DECORATION

[76] Inventor: Wendy Cohen, 450 W. 24th St., Studio 6A, New York, N.Y. 10011

[21] Appl. No.: 09/207,470

[22] Filed: Dec. 8, 1998

[51] Int. Cl.[7] ..... A01N 1/00

[52] U.S. Cl. ..... 428/16; 428/7; 428/542.2; 446/99; 446/321; 40/411

[58] Field of Search ..... 428/16, 7, 8, 542.2; 446/69, 85, 321, 99; 273/156; 248/27.8; 40/411

[56] References Cited

U.S. PATENT DOCUMENTS

| | | |
|---|---|---|
| D. 87,243 | 6/1932 | Seidel . |
| D. 148,841 | 3/1948 | Bush . |
| 1,847,687 | 3/1932 | Biertuempfel . |
| 2,203,540 | 6/1940 | Montgomery . |
| 2,439,178 | 4/1948 | Marchand . |
| 2,772,500 | 12/1956 | Cole et al. . |
| 2,838,873 | 6/1958 | Taylor . |
| 2,921,691 | 1/1960 | Dembinski . |
| 3,236,389 | 2/1966 | Murdock . |
| 3,277,602 | 10/1966 | Speers et al. . |
| 3,862,513 | 1/1975 | Isaacson et al. . |
| 4,461,790 | 7/1984 | Snider . |
| 4,626,222 | 12/1986 | Sweet . |
| 5,378,187 | 1/1995 | Forbes et al. . |
| 5,466,181 | 11/1995 | Bennett . |
| 5,480,337 | 1/1996 | Baker . |

*Primary Examiner*—Deborah Jones
*Assistant Examiner*—Wendy Boss
*Attorney, Agent, or Firm*—Hedman, Gibson & Costigan, P.C.

[57] ABSTRACT

A decoration having cooperating first and second figures so that a variety of first figures can be combined with a variety of second figures for a customized pairing. Further customizing is enabled with the use of interchangeable heads. A base for the figures and adaptable decorative columns can be added.

11 Claims, 9 Drawing Sheets

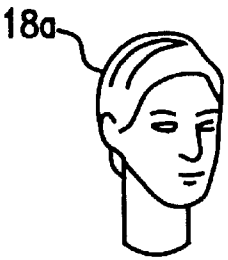
FIG. 6A
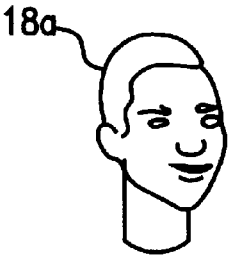
FIG. 6B
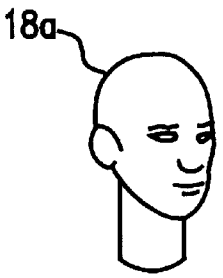
FIG. 6C
FIG. 6D
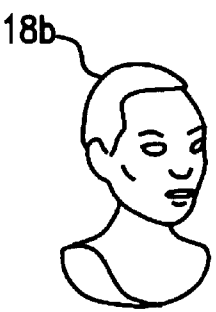
FIG. 6E
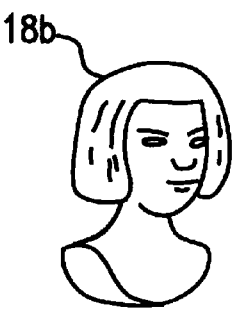
FIG. 6F

DECORATION

FIELD OF THE INVENTION

The present invention relates to decorative items, such as centerpieces, and decorations including toppers placed on cakes for decorative purposes.

BACKGROUND OF THE INVENTION

Decorations for festive purposes are widely used. One form of decoration for events celebrated between people is a small figure of a couple. This depiction can be in the form of an ornament, centerpiece or, most commonly, a cake topper.

Since shortly after cakes were decorated for festive purposes, decorations have included figures placed on the tops of cakes. One of the most popular decorations has been the use of a unitary decoration of a bride and groom on a wedding cake.

However, the decorations which are commercially available are limited in variety and aesthetic appeal. They are generic designs which cannot be modified or customized with the particulars of a specific couple.

As such, it is an object of the present invention to provide a decoration which can be customized to the particulars of an occasion and/or couple.

It is a further object to make figures interchangeable to form components of a decoration.

It is an additional object to make features of a figure interchangeable to further customize a decoration.

It is also an object to provide a method of manufacture to provide custom decorations.

SUMMARY OF THE INVENTION

These and other objects are achieved by the decoration of the present invention which comprises a first figure and a second figure, said first figure and second figure being preconfigured or preformed into corresponding interactive poses wherein one of a variety of first figures are able to mate with one of a variety of second figures in an interchangeable fashion to provide a custom user determinable pairings. Thus the invention allows for a great variety of possible pairings with a fairly limited number of individual first and second figures.

The first and second figures preferably have coupling means so that the figures can be maintained in a fixed interactive relationship.

Also, the first and second figures may have interchangeable features. For example, one or both of the figures may have an interchangeable head so that the look of the head on the body can be customized.

Additionally, an optional base is contemplated on which the desired first and second figures can stand. It is preferred that such base include engagement means for engaging at least one of the first or second figure, with a keyed engagement means being most preferred. The engagement means not only acts as an attachment between the base and the figures but also acts as a positioning means to ensure that the figures are properly positioned on the base.

Moreover, the figures may have additional features which can be interchanged. For example, one of the figures may have retention means for holding another featured item such as a bouquet of flowers, a baby, a dog, etc.

The present invention further contemplates custom accessories, including columns which can be adapted to stand individually, to contain a flower arrangement or to be connected by interconnecting means. Adaptability is provided by use of interchangeable components which engage the columns.

BRIEF DESCRIPTION OF THE DRAWINGS

The attached drawings, in which like reference characters represent like parts, are provided for illustration purposes only and are not intended to limit the present invention in any manner whatsoever.

FIGS. 6A–6C are examples of possible male heads in perspective for use on the first or second figures, or both, depending on the figure(s) being male.

FIGS. 6D–6F are examples of possible female heads in perspective for use on the first or second figures, or both, depending on the figure(s) being female.

DETAILED DESCRIPTION OF THE PREFERRED EMBODIMENT

Figure 4:
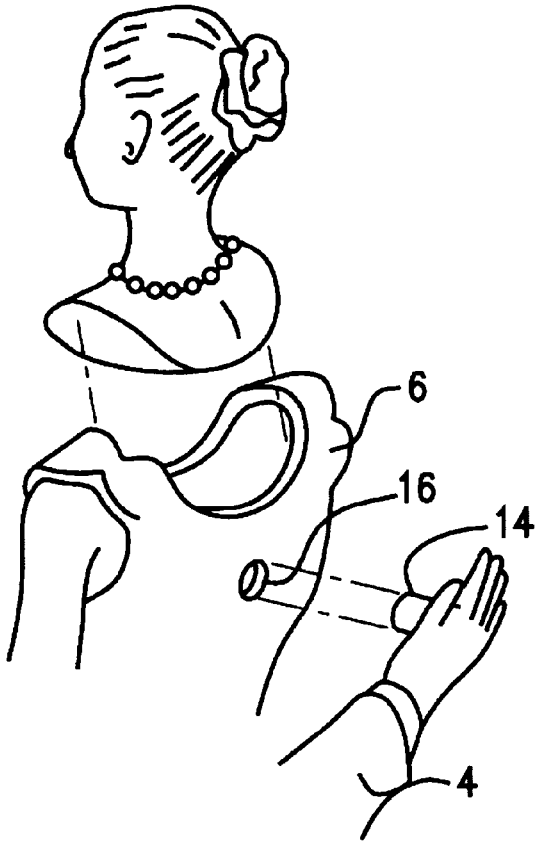
FIG. 4 is a partial exploded perspective of the preferred coupling means between the first and second figures of the present invention.
Figure 5:
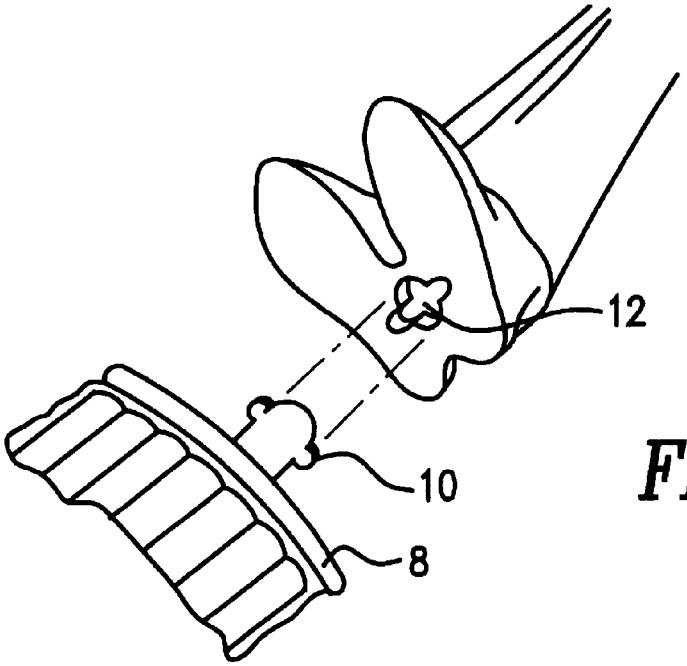
FIG. 5 is a partial exploded perspective of the preferred engagement means between the base and a figure of the present invention.

In its preferred embodiment the present invention comprises a decoration 2 with at least two figures, a first FIG. 4 and a second FIG. 6 (see FIGS. 1 and 7–9). The FIGS. 4 and 6 are preformed in fixed poses such that one of the various first FIGS. 4 can be interchangeably coupled with one of the various second FIGS. 6, providing for a number of customized pairings.

Preferably, but not necessarily, the figures are placed on a base 8. The base 8 preferably has a mounting pin 10, for holding and positioning the figures on the base 8, which cooperates with a mounting aperture 12 on the bottom of the first FIG. 4. In its most preferred embodiment the mounting pin 10 and mounting aperture 12 are keyed but at a 90° offset. For mounting, the mounting aperture 12 receives the mounting pin 10 and the first FIG. 4 is rotated 90° into its presentation position. Of course, the keyway may be cammed to provide a snug attachment of the first FIG. 4 to the base 8.

To maintain the FIGS. 4 and 6 in a fixed or semi-fixed paired relationship, the FIGS. 4 and 6 have cooperating coupling means. As best shown in FIG. 4, the first FIG. 4 has coupling detent 14 which engages a receiving aperture 16 to maintain the paired relationship. The detent 14/aperture 16 can be a force fit, held by friction, or there can be snap-fit or locking structures as are well known in the art.

Figure 2A:
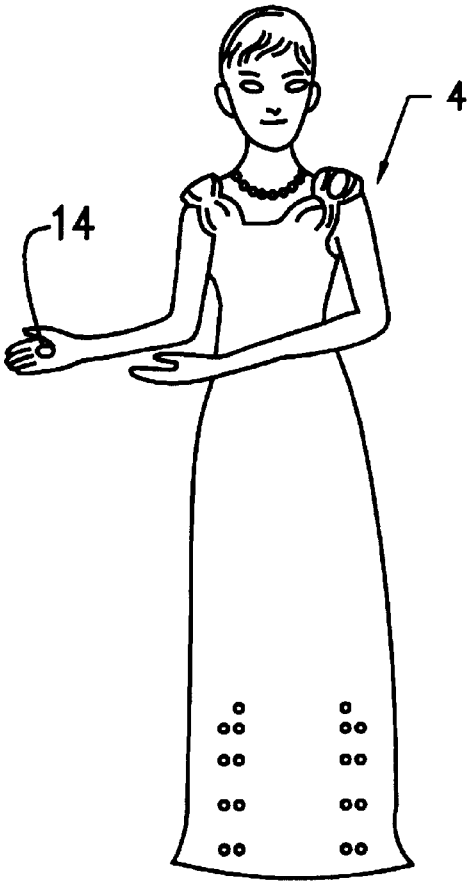
FIGS. 2A and 2B are examples of possible first figures for use in the present invention.
Figure 2B:
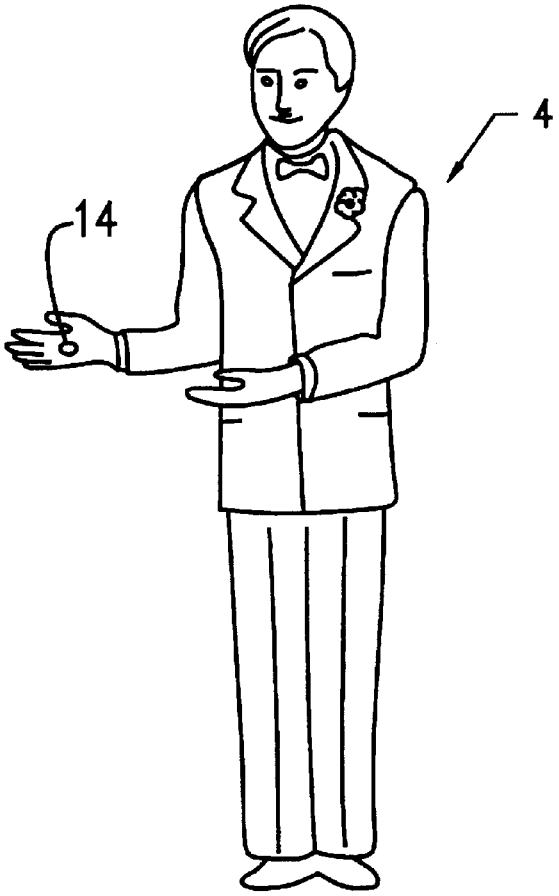
Figure 3A:
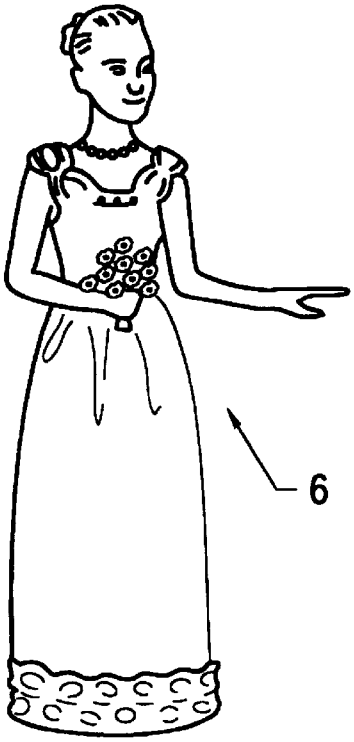
FIGS. 3A, 3B, 3C and 3D are examples of possible second figures for use in the present invention, with FIG. 3C being an exploded view.
Figure 3B:
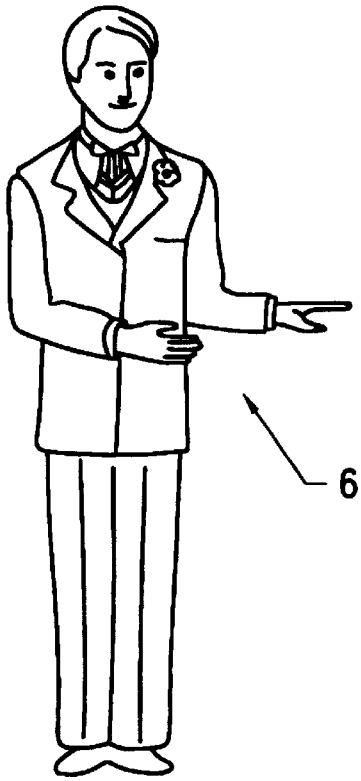
Figure 3C:
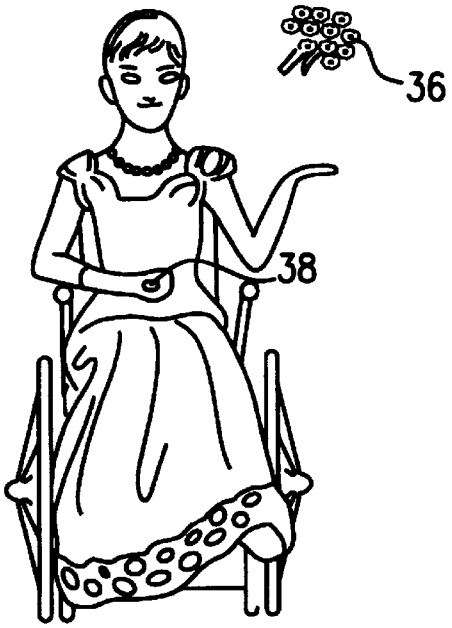
Figure 3D:
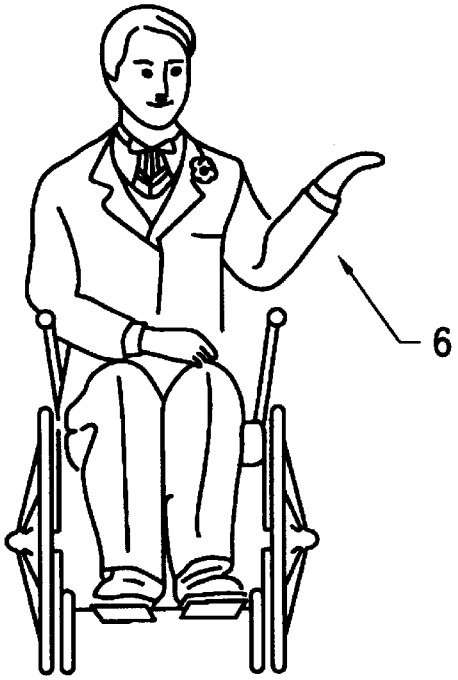

To facilitate the interchangeable aspect of the first and/or second figures, each of the first FIGS. 4 have a right hand with the coupling detent 14 at a predetermined location. Similarly, the first FIGS. 4 have a left hand extending across the body to accept the cooperating hand of the second FIG. 6 (see FIGS. 2A and 2B).

To cooperate with the first FIG. 4, each second FIG. 6 has a coupling aperture 16 at a predetermined location associated with the location of the coupling detent 14 of the first FIG. 4. Also, on the second FIGS. 6 the left hand is positioned to engage the left hand of the first FIG. 4.

The right hand of the second FIG. 6 can be holding an object such as a bouquet, a baby, etc. or merely positioned along the body, across the body or in the lap, etc. (see FIGS. 3A–3D). The object 36 in the right hand of the second FIG. 6 may have attachment means 38, similar to that described and shown in FIG. 4, so that it is removable and replaceable to provide a variety of user determinable featured elements. In one option contemplated herein, an older child can be positioned in front of the second FIG. 6 and the engagement means can maintain its position, much like the coupling detent 14/aperture 16 between the first and second FIGS. 4 and 6.

Figure 7:
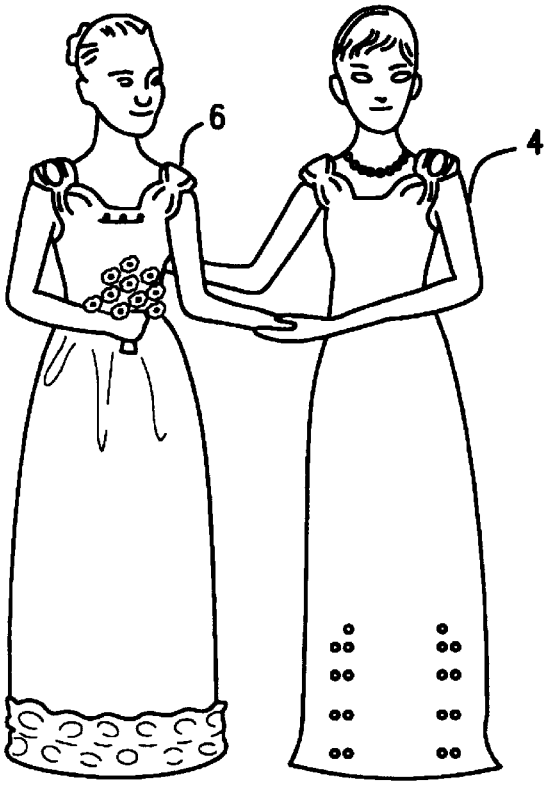
FIGS. 7–9 are examples of various combinations of first and second figures in elevation which are contemplated using the present invention.
Figure 8:
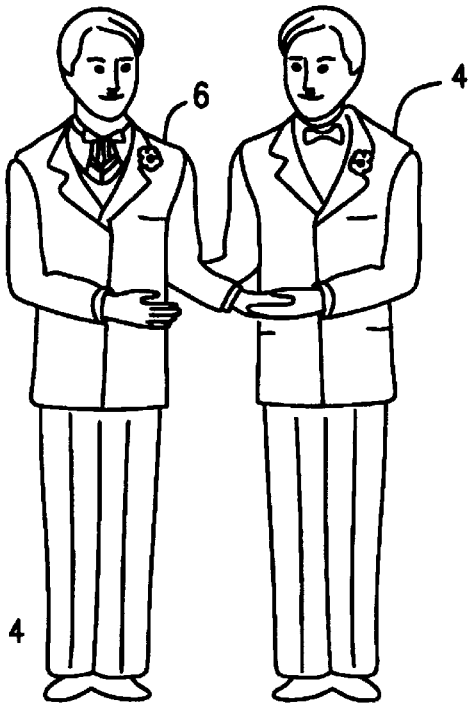
Figure 9:
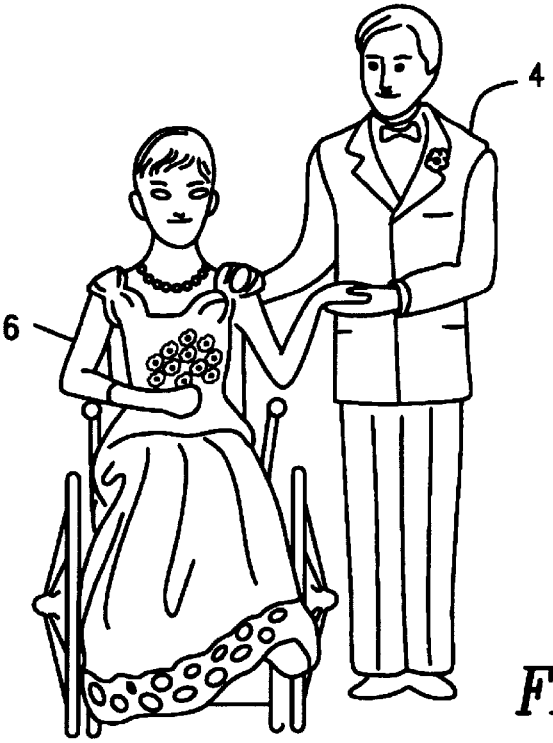

The interchangeability of the first and second FIGS. 4 an 6 allows for a variety of pairings. For example, FIG. 7 shows two female FIGS. 4 and 6, FIG. 8 shows two male FIGS. 4 and 6 and FIG. 9 shows a first FIG. 4 standing and a second FIG. 6 in a wheelchair. Of course, many possible variations of combinations exist, including variations for height, weight and outfit of the figures, i.e. in pants, short and long dresses, etc.

Figure 1:
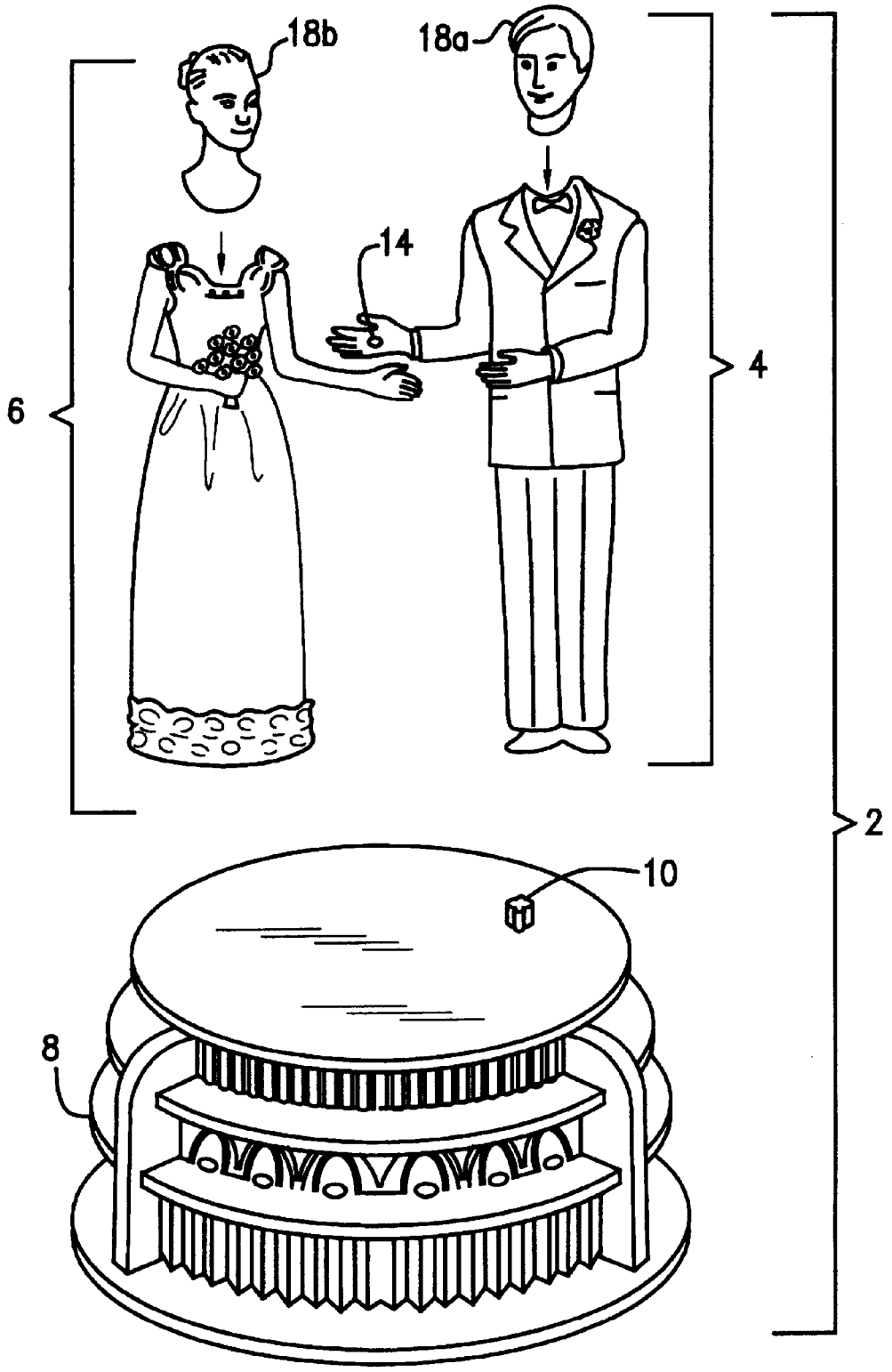
FIG. 1 is an exploded perspective view of the preferred embodiment of the customizable figures of the present invention.

Additionally, as shown in FIG. 1, the heads 18 of the figures can be interchangeable to provide a variety of different features. In the most preferred embodiment, the male heads 18*a* have a shaft-like neck to fit into a collar (see FIGS. 6A–C). The female heads 18*b* have a neck which continues down to the upper chest to fit into a dress (see FIGS. 6D–F).

Examples of differences in the heads include a white male in FIG. 6A, a black male in FIG. 6B and a bald male in FIG. 6C. Similarly, FIG. 6D shows a white female, FIG. 6E a black female and FIG. 6F an asian female. Of course, other adaptations can be made in the style or length of hair, the inclusion of beards or moustaches, etc. Moreover, the use of animal heads for the figures, such as dogs and cats, can be provided as novelty items for animal lovers.

Other accessories are also contemplated, such as veils, top hats and the like. These can be placed on or around the figures using common techniques known in the art.

Figure 10:
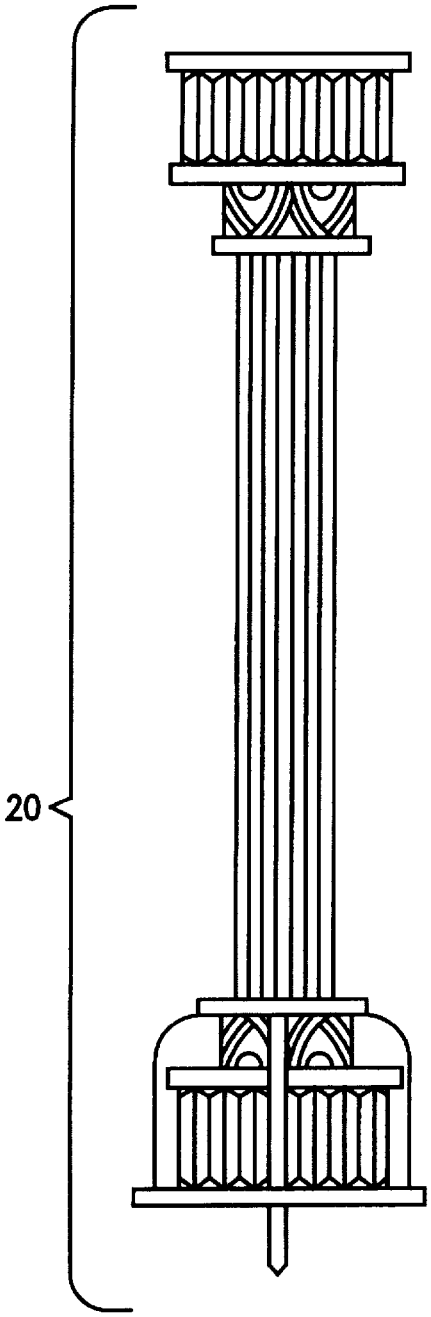
FIG. 10 is an elevational view of a preferred column accessory contemplated in the present invention.
Figure 11:
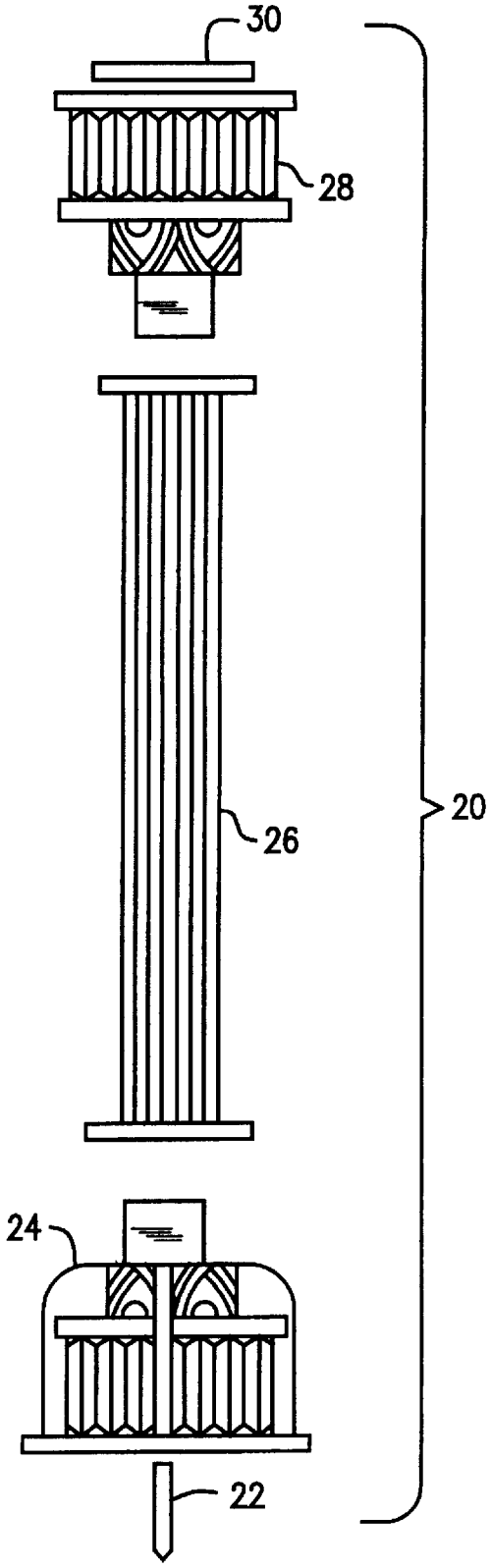
FIG. 11 is an exploded view of the column of FIG. 10.

Additional decorations with interchangeable aspects are also contemplated as part of the present invention, including a column 20 which can be used alone or with interchangeable elements. In the preferred embodiment (shown in FIGS. 10 and 11) the column 20 would be made of a pedestal 24, a post 26, a cup 28 and a cap 30 which are fit together. A peg 22 is also shown in FIGS. 10 and 11 to provide stability when the column 20 is used on a cake.

Figure 12:
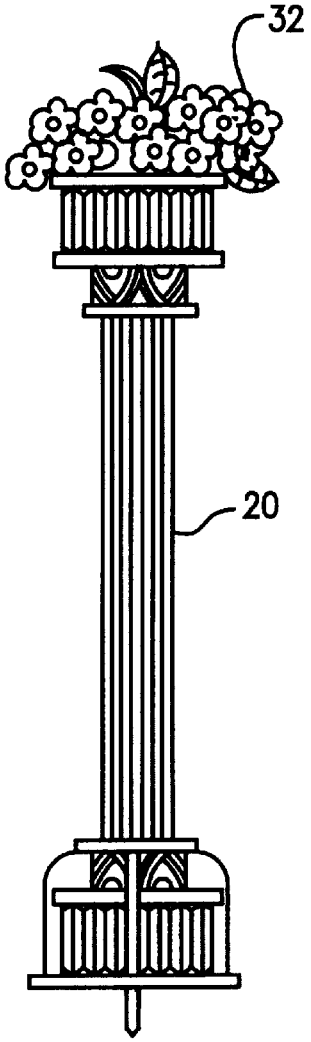
FIG. 12 is an elevation of the column accessory having an alternative decorative element.

As shown in FIG. 12 the cap 30 can be replaced by a flower arrangement 32 or the like to fill the cup portion of the column 20. If desired, the cup 28 can be filled with water or dirt to use real flowers or even have a styrofoam core into which fake flowers can be positioned.

Figure 13:
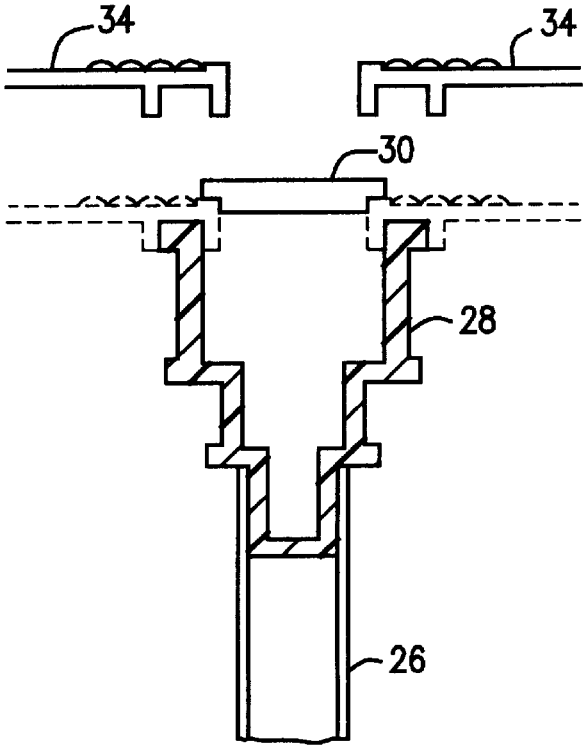
FIG. 13 is a partial cross section of the upper portion of the column accessory with an alternative decorative element.
Figure 14:
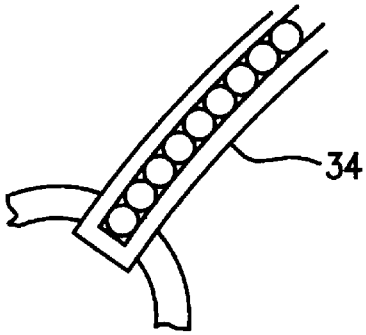
FIG. 14 is a plan view of the decorative element of FIG. 13.
Figure 15A:
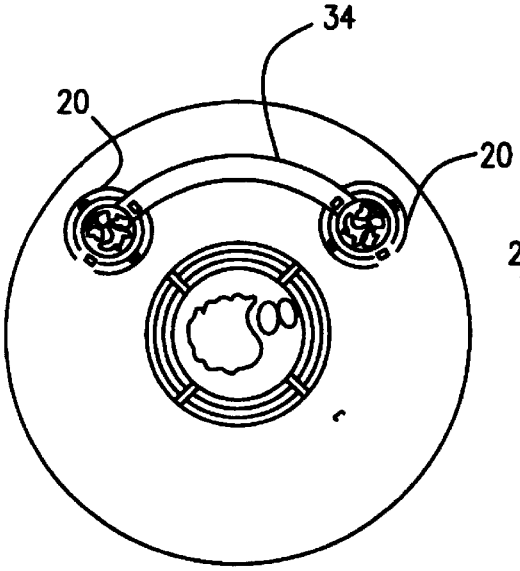
FIGS. 15A–15D are examples of column arrangements and interconnecting decorative elements contemplated by the present invention.
Figure 15B:
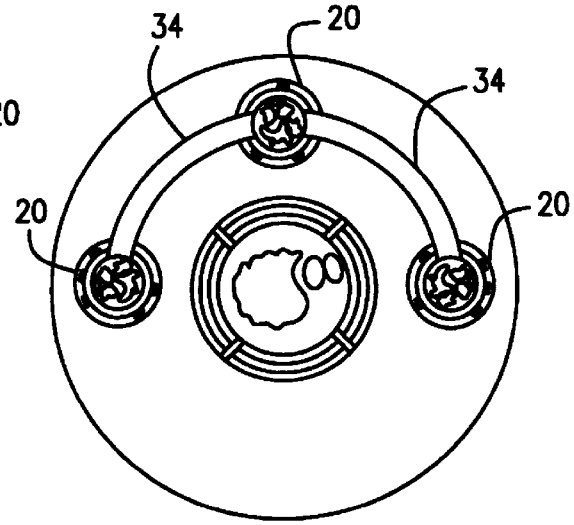
Figure 15C:
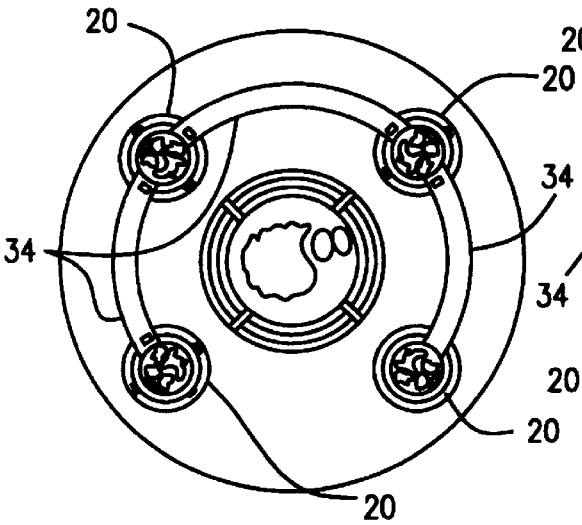
Figure 15D:
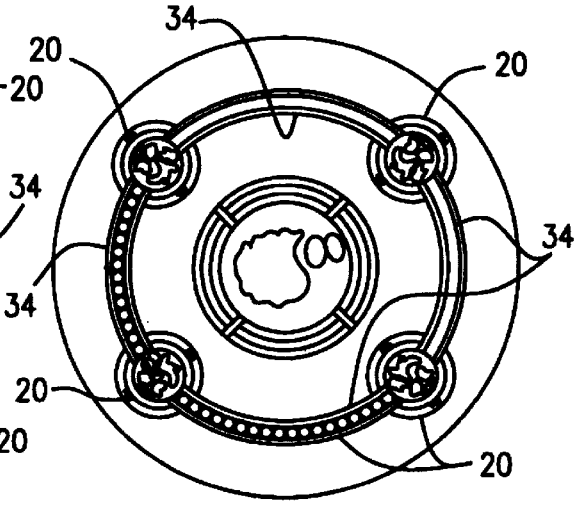

Similarly, one or more column bridges 34 can be used to connect adjacent columns 20 (see FIGS. 13 and 14). Of course, the number of columns 20 can vary. As shown in FIGS. 15A–D, two to four columns 20 are shown with bridges 34 between each, although plain columns 20 or columns 20 with flower arrangements 32 can be also used.

It is contemplated that the present invention will be made of plastic and, preferably, injection molded. Of course, the invention can be made of porcelain, metal or any other suitable material.

Additionally, the elements of the present invention can also be permanently attached, by snap fitting the elements with glue, epoxy or the like once the selections of the user are made. Moreover, the invention can be further customized by coating or painting the elements to select such specifics as, for example, hair color, complexion, clothing colors, and the like, or providing an overall glaze.

Finally, obvious variations of the invention described herein will make themselves apparent to those skilled in the art, all of which are intended to fall within the spirit and scope of the invention, limited only by the appended claims.

I claim:

1. A decoration comprising a first human figure, a second human figure and a base on which the first and second figures are placed, said first and second figure being adapted into corresponding interactive poses wherein one of a variety of first figures are able to couple with one of a variety of second figures in an interchangeable fashion to provide a custom user determinable pairing, the first and second figures having coupling means comprising cooperating elements for maintaining the first and second figures in fixed relationship with each other.

2. The decoration as in claim 1 wherein the base further comprises mounting means which cooperate with corresponding mounting means on at least one of the figures for holding and positioning the figures on the base.

3. The decoration of claim 2 wherein the mounting means comprises a detent which cooperates with a corresponding aperture.

4. The decoration of claim 1 wherein the cooperating elements comprise a detent on one of the figures and corresponding aperture on the other figure.

5. The decoration of claim 1 wherein at least one of the figures has interchangeable heads for user selection.

6. The decoration of claim 5 wherein the heads are slip fit onto the figures.

7. The decoration of claim 1 wherein one or more of the first or second figure comprises attachment means for an additional removable and replaceable element.

8. A method of making a decoration comprising the steps of selecting a first human figure, selecting a second human figure being configured in a corresponding pose with the first figure and coupling the first and second figures by engaging coupling means comprising inserting a coupling detent on one of said first or second figures into a coupling aperture on the other of said first or second figures.

9. The method of claim 8 further comprising the step of mounting of the figures on a base.

10. The method of claim 8 further comprising the steps of selecting a head for the first figure and placing the head on the first figure.

11. The method of claim 8 further comprising the steps of selecting a head for the second figure and placing the head on the second figure.

* * * * *